US005100511A

United States Patent [19]

Simonson et al.

[11] Patent Number: 5,100,511

[45] **Date of Patent: * Mar. 31, 1992**

[54] METHOD FOR THE MANUFACTURE OF PRODUCTS CONTAINING FIBERS OF LIGNOCELLULOSIC MATERIAL

[76] Inventors: Rune Simonson, Sotenäsvägen 64, S-433 64 Partille; Brita Ohlsson, N. Stommen 318, S-438 00 Landvetter; Birgit Östman, Ingentingsgatan 4, S-171 63 Solna, all of Sweden

[ * ] Notice: The portion of the term of this patent subsequent to Jan. 9, 2007 has been disclaimed.

[21] Appl. No.: 651,112

[21] Filed: Feb. 4, 1991

Related U.S. Application Data

[63] Continuation of Ser. No. 340,599, Mar. 30, 1989, abandoned.

[30] Foreign Application Priority Data

Oct. 3, 1986 [SE] Sweden ..... 8604212

[51] Int. Cl.[5] ..... D21H 17/23

[52] U.S. Cl. .....: 162/11; 156/62.4; 162/12; 162/13; 162/16; 162/150; 162/163

[58] Field of Search ..... 162/11, 16, 163, 12, 162/13, 150; 524/72; 156/62.4, 326

[56] References Cited

U.S. PATENT DOCUMENTS

| | | | |
|---|---|---|---|
| 1,873,056 | 8/1932 | Smith | 162/11 |
| 1,988,231 | 1/1935 | Barber et al. | 162/163 |
| 2,037,522 | 4/1936 | Lundback | 162/163 |
| 2,332,369 | 10/1943 | Burton | 162/163 |
| 2,470,764 | 5/1949 | Dunbar | 162/11 |
| 2,731,344 | 1/1956 | McKee | 162/11 |
| 3,236,720 | 2/1966 | Tousignant et al. | 162/163 |
| 3,305,435 | 2/1967 | Williston et al. | 162/163 |
| 3,403,074 | 9/1968 | Emerson | 162/163 |
| 4,191,610 | 3/1980 | Prior | 162/163 |
| 4,892,618 | 1/1990 | Simonson et al. | 162/16 |

FOREIGN PATENT DOCUMENTS

| | | | |
|---|---|---|---|
| 743861 | 10/1966 | Canada | 162/163 |
| 159479 | 10/1964 | U.S.S.R. . | |

*Primary Examiner*—Peter Chin

[57] ABSTRACT

A method for the manufacture of products containing fibers of lignocellulosic material which involves the disintegration of a lignocellulosic material into fibers and forming and pressing of the fiber web into the product in question, which is preferably in the form of fiberboard (board products). The material that forms the fibers is impregnated with lignin in conjunction with water and at a pH which does not substantially exceed 12.5. When the lignin has been absorbed by the material it is fixed against leaching by water through the modification of said lignin into an essentially water-insoluble form.

11 Claims, No Drawings

METHOD FOR THE MANUFACTURE OF PRODUCTS CONTAINING FIBERS OF LIGNOCELLULOSIC MATERIAL

This application is a continuation of application Ser. No. 07/340,599, filed as PCT/SE87/00445, Oct. 1, 1987, now abandoned.

TECHNICAL FIELD

The present invention relates to a method for the manufacture of products containing fibers of lignocellulosic material and which involves disintegration of a lignocellulosic material into fibers, forming and pressing of the fiber web into the product in question.

BACKGROUND

Products based on wood fibers, or other fibers of lignocellulosic material, in which the fibers have been bonded together to form a comparatively homogeneous body have found extensive uses in the construction industry. The predominant product is sheets of such material, i.e. fiberboards (hard board, fiber building boards), of varying densities, although some manufacture of more complex products also takes place. It has previously been difficult and expensive to develop such fiber-based products that can be used in the presence of moisture. Fiberboards and other fiber-based products are, accordingly, used mostly indoors in dry environments. To date the means of reducing their sensitivity to moisture has been treatment with oil to make oil-tempered fiberboard, usually with high density. The treatment is expensive and only results in boards with some water-repellant properties. However, the board will not become dimensionally stabilized by such a treatment.

TECHNICAL PROBLEM

The sensitivity of the fiberboard to moisture can be attributed to the fiber material The factors obstructing the manufacture of moisture-resistant fiber products are thus primarily the moisture absorption property of the fibers, the resultant dimensional changes and the tendency of the fiberboard towards cracking and disintegration on repeated wetting and drying. Another significant factor is the tendency of the fiber material to rot. A treatment intended to improve dimensional stability and resistance to rotting should therefore aim at alterations in the fibers themselves and not, primarily, in the fiberboard products.

THE SOLUTION

The obstacle to manufacturing fiberboards which are dimensionally stabilized and resistant to rotting is overcome by executing the present invention, which is defined in that the lignocellulosic material that forms the fibers is impregnated with lignin in conjunction with water and at a pH which does not substantially exceed 12.5, and wherein said lignin, once it has been absorbed by the fibers, is fixed against leaching by water through the modification of same into an essentially water-insoluble form.

ADVANTAGES

The present invention gives a method for the impregnation of fibers intended for the manufacture of fiber-based products, which produces a dimension stabilizing effect and a consequent reduction in cracking, and gives resistance to rot in an economically beneficial process.

BEST MODE OF CARRYING OUT THE INVENTION

The substance used for impregnation in the method in accordance with the invention contains as its active ingredient essentially lignin, appropriately derived from the alkaline kraft cooking process for the manufacture of paper pulp, i.e. waste liquor lignin. Such alkali lignin is known to be produced in large amounts in the course of the manufacture of paper pulp in accordance with this chemical pulping process. Such lignin is available in large quantities and at a price which makes it attractive in this context.

In order for the lignin to be capable of being absorbed by the fibers in the method according to the invention, it must be present in the form of an aqueous solution or an aqueous dispersion. Its liquid form thus renders it suitable for use in the established methods used for forming fiber-based products, e.g. fiberboards. It is, of course, appropriate to use water in this case for reasons of cost. Nor does the process of board forming offer feasible alternatives, as the water interacts with the water used in the forming process step (wet-forming) or with the moisture present in the fiber on dry-forming.

The lignin, which is only water-soluble to a limited extent in the form in which it is received, but is soluble in an alkaline solution, can be transformed into a fully water-soluble form, e.g. by carboxymethylation. The starting material is suitably kraft lignin (sulfate lignin) which has been precipitated by the addition of an acid at, for example, pH 9 from the industrial waste liquor from the kraft cooking process. The kraft lignin (sulfate lignin) is reacted in an aqueous solution (for 10 h at 90° C.) with NaOH and monochloroacetic acid in the mole ratio of 1:2:1, where the molecular mass for a C9-unit in the lignin is set to 200. The carboxymethylated lignin is precipitated with acid at a pH of about 2 and is isolated by centrifugation. To obtain a purification of the lignin, the lignin can be dissolved in acetic acid and subsequently reprecipitated.

The modification of the lignin into a water-soluble form can be carried out according to several methods of introducing hydrophilic groups in the lignin. In addition to carboxymethylation, carboxyethylation with chloropropionic acid provides another way of achieving a generally termed carboxyalkylation. Carboxylation by oxidation, e.g. with oxygen or air in accordance with the oxygen bleaching step used for paper pulp bleaching, can also be used, as well as sulfonation. Different methods of modifying the lignin can be used sequentially.

The impregnation with lignin required for use of the method according to the present invention can be performed as described below.

In the industrial manufacturing of fiber pulp to be used in fiber-based products (board), lignocellulosic material like wood chips is defibrated at high temperature (usually 120°–170° C.) in a disc defibrator equipped with one or two rotating discs. The hot fiber pulp discharged from this defibration step has a dry content of 30–60%, and can suitably be directly transported and immersed into the impregnating solution containing lignin, the solution having a temperature of 10°–80° C. Excess impregnating solution can be drained or pressed off from the fiber material It is essential for good results that the fibers be thoroughly impregnated with the solution. The amount of lignin added to the fiber pulp can be adjusted by regulating the lignin concentration in the impregnating solution. The lignin can also be added to the fiber pulp such that the lignin-containing impregnating solution is sprayed or sprinkled over the fiber pulp, for example at the passage of the fiber pulp through the so-called blow-line used for transportation of the fibers from the disc refiner (beater).

It is, as mentioned, important to achieve a good uptake of the impregnating solution in the fibers. Spraying or sprinkling the solution must therefore be carried out with care, and it might be necessary to supply the said blow-line with a storage tank where the fibers can reside and absorb the solution, thereby improving the diffusion of lignin into the fiber walls.

Without special modification, the lignin has, as mentioned, a limited solubility in water, but it can be added to the fiber pulp in that state in a soluble form by making the impregnating solution alkaline, the pH being substantially below 12.5. The impregnating solution penetrates into the fiber material in such a way that impregnation is obtained.

However, after impregnation the lignin, in its at least partially water-soluble form, is susceptible to leaching in water and in this state the material is not suitable for use in those applications for which it is primarily intended, i.e. out of doors. It is accordingly necessary to fix the lignin by transforming it into a water-insoluble form. This can be achieved by treating the fiber material in a second step with an aqueous solution of metal salts such as aluminum salt, copper salt or a mixture of aluminum and copper salt, respectively. Even used in small amounts, copper provides additional protection against rot. The combination of lignin and copper affords excellent resistance to white rot and brown rot fungi, and also to soft rot fungi and tunnelling bacteria from non-sterile soil.

In certain cases, even weak acidification of the material might be enough to achieve a good fixing action. Although the fixing is generally intended to be performed by the addition of metal salt as stated above, this does not prevent the fixing solution, at least in some cases, from being an acidic solution with no metal salts.

The fixing step can be performed in different ways depending on the intended method of forming the fiberboards. Thus, the fiber pulp can, after the excess of impregnating solution containing lignin has been removed by pressing or drainage, be furnished with an aqueous solution containing e.g. aluminum salt, to achieve fixing. Excess fixing solution can be removed in a second drainage or pressing step, before the fiber material is further treated in accordance with an established method for the forming of fiberboard. If wet-forming of fiberboards is to be used, the fixing solution, preferably aluminum salt (possibly in combination with copper salt), can be added to the so-called stock dilution water, furnish water, at which a fixing of the lignin material absorbed by the fiber occurs before the fiber suspension is fed to the endless wire (net) of the board machine used for wet-forming.

Another variant of the method according to the invention for manufacturing of lignin-impregnated fiber material is to impregnate the lignocellulosic material, e.g. wood chips, chippings or shavings, with a lignin solution before the material is disintegrated to fibers in a disc beater (defibrator). If the material is not defibred before the impregnation but is still in the form of chips, chippings or shavings, great care must be taken in terms of the uptake of impregnating lignin solution by the material, e.g. by increasing the time of exposure between the material and the solution. To avoid precipitation of salts and clogging of the beating parts of the defibrator, or corrosion on the equipment, the fixing of the lignin material can suitably be carried out in a step following the defibration/refining.

It has been observed in conjunction with the invention that the aqueous solution of lignin should not be excessively alkaline (pH max. 12.5). This makes it easier to achieve good results. By avoiding the use of an excessively alkaline solution, the inherent resistance of the lignocellulosic fiber itself to rotting is affected to a lesser extent. On the other hand, the action of an alkali on the fiber causes a certain degree of fiber swelling with consequent improved penetration of the lignin into the fiber cell wall. This results, in turn, in improved impregnation. It is accordingly important to adjust the pH value so that a good impregnation effect is achieved in return for a reasonable decrease in the natural resistance of the fiber material to rot. The optimum pH value is in the range between 6 and 11. The decrease in the resistance to rot obtained as a result of the use of strongly alkaline solutions can be eliminated by the addition of copper.

The fixing solution is provided in an appropriate form by using a weakly acidic solution, which improves the fixing effect by facilitating the chemical process which transforms the lignin into its water-insoluble form. If this fixing process is performed with the addition of metal salts, e.g. aluminum salt, a relatively large quantity of metal ions is required, and the quantity increases in step with the increase in the quantity of lignin used in impregnation. At the commonly used lignin concentrations, the quantity of metal ions required is greater than that provided by the copper required for the aforementioned additional protection against rot. Since the price of copper is higher than the price of aluminum, it is accordingly advisable to make up the fixing solution partly of copper salt, in the amount necessary for the aforementioned additional protection against rot, with the rest being based on an aluminum salt to provide the necessary fixing action. Zinc may be used instead of copper. The aforementioned protection against rot requires the fiber material to contain copper in an amount, which may be limited to 1%, calculated on the quantity of dry fiber, in relation to the type of fiber used and the quantity of lignin added. The smallest quantity of copper necessary to provide good additional protection against rot, i.e. the threshold value, varies with the type of raw material used. It is generally true, however, that fibers from hardwoods as a rule require about twice the quantity required for fibers from conifers, for instance pine wood.

It must be pointed out that the fiber material, owing to its small particle size and disintegrated form, is comparatively easy to impregnate. Favourable penetration conditions may therefore be expected. In many cases it is thus possible to avoid having to take special measures, such as achieving complete solubility in water, to increase penetration.

It is also possible to perform the fixing operation by heat treatment, in which case splitting of acetyl groups in the fiber material and a chemical reaction between the fiber material and the lignin, preferably in the form of an ammonium salt, will assist in the transformation of the lignin into a water-insoluble form. The temperature of the heat treatment must be at least 80° C., and preferably 110° C., for a good reaction to take place. The heat treatment can suitably be carried out in conjunction with the pressing and drying of the fiber board at a high temperature (usually 200°-250° C.)

It follows that fixing by heat can be carried out by adding ammonia and/or ammonium salt to the impregnating solution containing lignin, allowing the fixing to be carried out in a second step in which the fiber material is heated to a temperature of at least 80° C. This heating step is preferably carried out in conjunction with the drying of the fiber material to low moisture content before pressing and/or in conjunction with pressing into the consolidated product. The modification of the lignin into a water-insoluble form is thereby achieved by a chemical reaction between the fiber material and the lignin material. As mentioned above, the presence of a balanced amount of copper results in increased resistance to rotting. Such an addition can also take place when heat fixing is used. In a step prior to the heating, the fiber material is then supplied with copper, preferably by impregnating the fibers with an aqueous solution of a copper salt. As an alternative zinc can be used, in which case the impregnation is carried out with a solution containing a zinc salt. The amounts of metal salts required do not need to be as high as if the fixing was performed merely by the addition of metal salt. Instead, the order of magnitude required is the same as that to achieve the additional protection against rot. The fixing action in this case is achieved by the heat treatment itself.

As is evident from the above, the forming of the final product, usually board products, from impregnated fibers can be done by well-known, established methods. Two different methods can be distinguished, namely wet-forming and dry-forming.

In wet-forming, the fibers are suspended in the water used for the forming process, the stock dilution water or furnish water, and the fiber suspension is transferred to the endless wire (net) of the wet lap forming machine. The suspension is dewatered on the wire net. The fibers are then pressed together, between usually cold rollers, and the product is finally pressed in a heated press. The fibers in the final product are held together by the adhesion which results from the pressing of the fiber material. Adhesives (glue) can also be used.

In dry-forming, a layer of the fiber material with a given moisture content, usually max. 10%, is arranged in a press, and the final product is formed by pressing. In this case, too, the fibers are held together by adhesion, but the binding of the fibers is usually reinforced by the addition of adhesives (glue).

As mentioned above, the impregnation of the fibers in the method according to the invention is aways carried out before the forming takes place. In wet-forming, the fixing of the lignin can be done in the fiber before the forming step, or in conjunction with the forming by addition of the fixing solution to the stock dilution water. In dry-forming, the lignin can be fixed before the forming is executed. The forming should then be done before the fiber material has dried after the fixing, since the material requires a certain moisture content in the pressing.

As evident from the description given above, the impregnation according to the invention can be performed by different, alternative routes. The raw material might be any lignocellulosic material. The final products are, as stated, fiber products, mainly fiberboards (board products).

Alternative I

Step 1. Washing of the material (e.g. wood chips), preheating.
2. Defibration, refining in a disc beater.
3. Impregnation of the fibers from step 2 with lignin solution.
4. Drainage, possibly in combination with pressing. The impregnating solution which is drained off can be recirculated to step 3.
5. Fixing by addition of fixing solution like aluminum salt solution, with possible addition of copper salt.
6. Drainage, possibly in combination with pressing. The fixing solution drained can be recirculated to step 5.
7. Forming of the fiber product according to established wet or dry-forming methods.

Alternative II

Step 1. Washing of the material (e.g. wood chips), preheating.
2. Defibration, refining in a disc beater.
3. Impregnation of the fibers from step 2 with lignin solution.
4. Drainage, possibly in combination with pressing. The impregnating solution which is drained off can be recirculated to step 3.
5. Preparation of a fiber suspension (fiber stock solution) suitable for forming according to the wet-forming method.
6. Addition of the fixing solution in the form of aluminum (and possibly copper) salt solution to fix the lignin in the fibers.
Note: Steps 5 and 6 can suitably be carried out together, on preparation of the fiber stock solution (fiber suspension), by adding the substances necessary for the fixing according to step 6 to the stock dilution water used in step 5.
7. Final forming of the product according to the wet-forming method.

Alternative III

Step 1 Washing of the material (e.g. wood chips), preheating.
2. Impregnation of the material with lignin solution.
3. Drainage, possibly in combination with pressing. The impregnating solution which is drained off can be recirculated to step 2.
4. Defibration, refining in a disc beater.
5. Fixing by addition of fixing solution like aluminum (and possibly copper) salt solution.
6. Drainage, possibly in combination with pressing. The fixing solution drained can be recirculated to step 5.
7. Forming of the fiber product according to established wet or dry-forming methods.

Alternative IV

Step 1. Washing of the material (e.g. wood chips), preheating.
2. Impregnation of the material with lignin solution.
3. Drainage, possibly in combination with pressing. The impregnating solution which is drained off can be recirculated to step 2.
4. Defibration, refining in a disc beater.
5. Preparation of a fiber suspension suitable for forming according to the wet-forming method.
6. Addition of aluminum (and possibly copper) salt solution to fix the lignin in the fibers.

Note: Steps 5 and 6 can suitably be carried out together, on preparation of the fiber stock solution (fiber suspension), by adding the substances necessary for the fixing according to step 6 to the stock dilution water used in step 5.

7. Final forming of the product according to the wet-forming method.

Alternative V

Step 1. Washing of the material (e.g. wood chips), preheating.
2. Defibration, refining in a disc beater.
3. Impregnation of the fibers from step 2 with lignin solution.
4. Drainage, possibly in combination with pressing. The impregnating solution which is drained off can be recirculated to step 3.
5. Forming of the fiber product, preferably according to the dry-forming method, and a simultaneous fixing of the lignin by the heating required in the forming.

Alternative VI

Step 1. Washing of the material (e.g. wood chips), preheating.
2. Impregnation of the material with lignin solution.
3. Drainage, possibly in combination with pressing. The impregnating solution which is drained off can be recirculated to step 2.
4. Defibration, refining in a disc beater.
5. Forming of the fiber product, preferably according to the dry-forming method, and a simultaneous fixing of the lignin by the heating required in the forming.

Alternatives I–IV all refer to fixing with a solution. Fixing by heat has been mentioned as another possibility. Such heat fixing may replace the fixing step and the subsequent drainage step in alternatives I and III, especially in those cases where the dry-forming method is used. Examples of heat fixing are given in alternatives V and VI.

The impregnation and fixing steps given are described in detail below in Examples 1–3, and the results obtained are given in Tables 1 and 2. The Examples refer to experiments made on a laboratory scale. It is, however, possible for the routineer to transfer this scale to production scale by choosing the performance amongst alternatives I–VI which is most applicable under the specific manufacturing conditions in question. It must also be obvious to the routineer that the methods described can be used, wholly or in their applicable parts, for manufacturing of products containing fibers from lignocellulosic materials other than wood, such as bamboo, bagasse, straw, etc. It is also understood that lignin preparations others than those derived from kraft lignin might be used, e.g. lignins from lignocellulosic material which has been treated with organic solvents (solvent cooking) or steam (explosion wood pulp).

EXAMPLE 1

Fiber pulp used for manufacturing of fiberboard was steamed with water vapor at 100° C. and then immersed in a room-temperature water solution containing fractionated kraft lignin (sulfate lignin). The pH value of the impregnating solution was about pH 11. The procedure given above was carried out at two different concentrations of lignin in the impregnating solution: 15 and 5%.

Excess impregnating solution was removed by pressing, and the fiber material was dipped into an aluminum chloride solution (2%) for fixing (modification) of the lignin into a water-insoluble form.

The fiber pulp was diluted with water to a fiber stock concentration of 1.5%, and the pH was adjusted to pH 4. Wet-forming of fibers was then performed in a laboratory sheet former. The fiber material was pressed in a cold press for 1 min at 1 MPa to a dry content of about 30%. Hot-pressing to a fiberboard sheet was finally carried out at 210° C. and to a sheet thickness of 3 mm.

In some cases the sheets were post-treated with heat, heat treating, for 4 hrs at 165° C.

Controls were prepared in the same way and from the same raw material except that no lignin impregnation and no fixing were performed.

Samples (10×10 cm) of different boards were tested with respect to water absorption (wt. %) and thickness swelling (%) after immersing in water (20° C.) for 24 hrs. The test results are given in Table 1 (samples A and B).

EXAMPLE 2

Fiber pulp was treated as in Example 1, except that the impregnation with lignin was performed with a water-soluble, carboxymethylated kraft lignin. The pH-value of the impregnating solution was 7.5 and the concentration of lignin was about 10%. The fixing was done in accordance with Example 1. The test results are given in Table 1 (sample C).

EXAMPLE 3

In order to study the effect of a simultaneous attack of different rot fungi such as white, brown and soft rot fungi as well as of tunnelling bacteria, wood samples impregnated to different contents of lignin and copper, respectively, were exposed to unsterile soil in a fungus cellar. The results, found after a exposure time of 9.5 months, are given in Table 2. As can be seen from the table, all samples (except untreated controls) showed good results, even those samples which were impregnated to a low lignin content.

TABLE 1

Test results obtained for lignin-impregnated fiber building boards (density 1000 kg/m$^3$)

| Sample | Lignin material | Lignin conc, % | Heat treatment (4 hrs, 165° C.) | Thickness swelling, % 24 hrs | Water absorption, % 24 hrs |
|---|---|---|---|---|---|
| A | Kraft lignin | 15 | No | 8% | 29% |
| | | | Yes | 6% | 20% |
| B | Kraft lignin | 5 | No | 16% | 43% |
| | | | Yes | 10% | 22% |
| C | Carboxymethylated kraft lignin | 10 | No | 12% | 35% |
| | | | Yes | 10% | 20% |
| Con- | — | — | No | 68% | 100% |

TABLE 1-continued

Test results obtained for lignin-impregnated fiber building boards (density 1000 kg/m$^3$)

| Sample | Lignin material | Lignin conc, % | Heat treatment (4 hrs, 165° C.) | Thickness swelling, % 24 hrs | Water absorption, % 24 hrs |
|---|---|---|---|---|---|
| trols | | | Yes | 35% | 66% |

TABLE 2

Fungus cellar tests. Exposure time 9.5 months.

| Lignin | pH | Lignin uptake % | Cu % | Rating*,** |
|---|---|---|---|---|
| Carboxymethylated standard lignin | 7.5 | 1.7 | 0.26 | 0–0, 0–1, 0–2, 0–0 |
| Carboxymethylated standard lignin | 7.5 | 2.7 | 0.38 | 0–0, 0–0, 0–0, 0–1 |
| Carboxymethylated standard lignin | 7.5 | 3.9 | 0.32 | 0–0, 0–0, 0–1, 0–1 |
| Carboxymethylated standard lignin | 7.5 | 5.2 | 0.30 | 0–0, 1–1, 1–0, 0–0 |
| Carboxymethylated standard lignin | 7.5 | 7.2 | 0.36 | 0–0, 0–1, 0–0, 1–0 |
| Carboxymethylated standard lignin | 7.5 | 10.3 | 0.38 | 0–0, 0–0, 0–0, 0–0 |
| Carboxymethylated low-molecular-weight lignin | 7.3 | 1.8 | 0.33 | 0–0, 0–0, 0–1, 0–0 |
| Carboxymethylated low-molecular-weight lignin | 7.3 | 3.6 | 0.37 | 0–2, 0–0, 0–0, 0–1 |
| Carboxylated lignin | 7.5 | 1.4 | 0.21 | 0–0, 1–0, 0–0, 0–0 |
| Carboxylated lignin | 7.5 | 3.8 | 0.25 | 0–0, 2–2, 2–0, 0–2 |
| Carboxylated lignin | 7.5 | 7.6 | 0.22 | 0–0, 0–1, 0–0, 0–0 |
| Carboxylated lignin | 8.5 | 6.7 | 0.32 | 0–0, 1–0, 0–2, 0–0 |
| Carboxylated lignin different formula | 7.5 | 1.7 | 0.23 | 0, 2, 0, 1 |
| Carboxylated lignin different formula | 7.5 | 4.3 | 0.28 | 0, 0, 1, 0 |
| Carboxylated lignin different formula | 7.5 | 5.9 | 0.21 | 1, 0, 2, 1 |
| Carboxylated lignin different formula | 8.5 | 2.0 | 0.23 | 1, 0, 0, 0 |
| Carboxylated lignin different formula | 8.5 | 4.5 | 0.21 | 0, 1, 0, 0 |
| Carboxylated lignin different formula | 8.5 | 4.6 | 0.25 | 0, 0, 0, 1 |
| Untreated controls | | | | 4 |

*Rating 1–5, 5 = totally destroyed.
**Four samples were tested. Some of them were divided into two parts, and each part was rated separately.

We claim:

1. A method for the manufacture of a solid product composed of lignocellulosic fibers, comprising:

mechanically and non-chemically disintegrating a lignocellulosic material in one or two steps in a fibre pulp;

isolating an alkali lignin from waste liquor from an alkaline cooking of wood;

forming an aqueous solution of the alkali lignin and derivatives thereof which has a pH not exceeding 12.5;

impregnating said lignocellulosic material in its partly or fully disintegrated form with said lignin solution so that the lignocellulosic material absorbs the lignin and absorbed lignin is thereby obtained;

fixing the lignin absorbed into the lignocellulosic material by treating said fiber pulp with a weakly acidic aqueous solution containing metal ions derived from salts selected from the group consisting of aluminum salts, zinc salts and copper salts, so as to render the absorbed lignin insoluble in water to fix the lignin in the fiber pulp against leaching by water; and thereafter compressing the fiber pulp to form a solid product in which fibers of the fiber pulp are bonded in the solid product.

2. The method according to claim 1, wherein the fixing solution contains copper salt in a quantity such that the amount of copper ion in relation to dry fiber in the fiber pulp is at most up to 1% only, and the fixing solution contains aluminum salt in a quantity such that the lignin is fixed by a combined effect of the salts.

3. The method according to claim 1 or 2, wherein the alkali lignin is modified into carboxylated alkali lignin by oxidation, in order to achieve improved water solubility.

4. The method according to claim 3, wherein the lignin is further modified by sulfonation.

5. The method according to claim 1 or 2, wherein the alkali lignin is modified into one of carboxymethylated alkali lignin and caboxylethylated alkali lignin, in order to achieve improved water solubility.

6. The method according to claim 5, wherein the lignin is further modified by sulfonation.

7. A method for the manufacture of a solid product containing lignocellulosic fibers, comprising the steps of:

mechanically and non-chemically disintegrating lignocellulosic material into a fiber pulp;

impregnating of said lignocellulosic material with an alkali lignin aqueous solution having a pH not to exceed 12.5 wherein one part ammonia and ammonium salt is added;

fixing the lignin adsorbed into the fiber pulp by heating the fiber pulp to a temperature of at least 80° C. thereby drying the fiber to a low moisture content;

compressing the fiber pulp in the form of a web so that the fibers are bonded to a desired solid product.

8. The method of claim 7, wherein the fixing by heating is preceded by a step of adding copper to the fiber through impregnation with a solution of a copper salt.

9. The method according to claim 7, wherein the fixing by heating is preceded by a stage in which the fiber has zinc added to it, through impregnation with a solution of a zinc salt.

10. A method for the manufacture of a solid product containing lignocellulosic fibers, comprising the following steps:

mechanically and non-chemically disintegrating a lignocellulosic material into a fibre pulp in two operating steps, a first operating step wherein the lignocellulosic material is disintegrated into a non-defibrated form and a second operating step wherein final defibration of the lignocellulosic material occurs;

impregnating the lignocellulosic material after said first operating step with alkali lignin and derivatives thereof in a solution with water having a pH not exceeding 12.5;

fixing the alkali lignin and derivatives thereof into the lignocellulosic material against leaching of water in or after said second operating step, by modifying the alkali lignin and derivatives thereof into an essentially water insoluble form by treating the fibre pulp with a weakly acidic aqueous solution, the solution containing metal ions derived from salts selected from the group consisting of aluminum salts, zinc salts and copper salts; and compressing the fiber pulp so that the fibers of the pulp are bonded into a desired solid product.

11. A method for the manufacture of a solid product containing lignocellulosic fibers, comprising the steps of:

mechanically and non-chemically disintegrating lignocellulosic material into a fiber pulp;

impregnating said fiber pulp with an aqueous solution of alkali lignin or derivatives thereof at a pH not exceeding 12.5;

fixing the water soluble alkali lignin by adding to said said fiber pulp a weakly acidic water solution containing metal ions derived by adding salts selected from the group consisting of aluminum salts, zinc salts and copper salts, so that the lignin adsorbed into the fiber pulp becomes insoluble;

forming a solid product by a wet forming process including draining of the fiber pulp by compressing the aqueous suspension of the previous step;

compression of the fiber pulp to form a web so that the fibers are bonded into a desired solid product.

* * * * *